United States Patent [19]

Bergstrom

[11] 3,940,269

[45] Feb. 24, 1976

[54] SINTERED AUSTENITIC-FERRITIC CHROMIUM-NICKEL STEEL ALLOY

[75] Inventor: Theodore R. Bergstrom, Little Canada, Minn.

[73] Assignee: Minnesota Mining and Manufacturing Company, St. Paul, Minn.

[22] Filed: July 9, 1971

[21] Appl. No.: 161,916

Related U.S. Application Data

[62] Division of Ser. No. 743,588, July 10, 1968, Pat. No. 3,620,690.

[52] U.S. Cl. ..... 75/214; 75/200; 75/224

[51] Int. Cl.[2] ..... B22F 3/16

[58] Field of Search ..... 75/200, 214, 224

[56] References Cited

UNITED STATES PATENTS

| | | | |
|---|---|---|---|
| 2,872,311 | 2/1959 | Marshall et al. | 75/200 |
| 2,920,958 | 1/1960 | Bergh | 75/200 |
| 3,109,735 | 11/1963 | Googin | 75/224 |
| 3,126,279 | 3/1964 | Bergh | 75/200 |
| 3,223,523 | 12/1965 | Adler | 75/200 X |

OTHER PUBLICATIONS

Clark et al., *Physical Metallurgy For Engineers*, Van Nistrand, N.Y., (1962), pp. 324–328.

*Primary Examiner*—Leland A. Sebastian
*Assistant Examiner*—R. E. Schafer
*Attorney, Agent, or Firm*—Alexander, Sell, Steldt & DeLaHunt

[57] ABSTRACT

Powdered austenitic chromium-nickel stainless steel is blended with a powdered metal ferrite stabilizer, such as molybdenum, and the resulting blend is sintered to produce a new steel, namely, an unwrought austenitic-ferritic chromium-nickel alloy having, as sintered, desirably high tensile and yield strength and other desirable properties.

24 Claims, No Drawings

SINTERED AUSTENITIC-FERRITIC CHROMIUM-NICKEL STEEL ALLOY

RELATED APPLICATION

This application is a division of my copending application Ser. No. 743,588, filed July 10, 1968, now U.S. Pat. No. 3,620,690.

FIELD OF THE INVENTION

This invention relates to powder metallurgy of stainless steel. In another aspect, it relates to the manufacture of sintered stainless steel articles from powdered metals. In another object, it relates to a novel mixture of powdered stainless steel and powdered metal ferrite stabilizers. In a further aspect, it relates to a shaped article of a novel chromium-nickel steel alloy and a method for its preparation using principles of powder metallurgy.

BACKGROUND OF THE PRIOR ART

Austenitic chromium-nickel stainless steels are enjoying an increasing wide-spread industrial application as engineering alloys because of their resistance to corrosion and desirable mechanical properties. Unfortunately, these steels are not significantly hardenable by or responsive to heat treatment; phase transformation is suppressed by the nickel constituent in these steels and austenite (the gamma form of iron) is substantially retained on cooling from the gamma region. The mechanical properties of these austenitic steels cannot be controlled or varied by the usual types of heat treatment, such as quenching and tempering. Changes in mechanical properties, such as strength, are brought about only by expensive, time-consuming cold working (rolling) and annealing, resulting in the so-called wrought austenitic stainless steel. (See "Forming of Austenitic Chromium-Nickel Stainless Steels" 2nd Ed. (1954), published by The International Nickel Co., Inc., New York, N.Y.).

In accordance with this invention, desirable changes in austenitic chromium-nickel stainless steels are brought about by a certain novel powder metallurgy technique, resulting in a sintered or unwrought alloy having increased strength and other desirable mechanical properties.

Powder metallurgy broadly is not a new type of metallurgical process but it is receiving increasing application in the manufacture of metallic articles, extending as it does the design limits of liquid metallurgy. An excellent description of this metallurgical process is found in "Review of the Powder Metallurgy Process," July, 1966, published by the U.S. Army Production Equipment Agency, Manufacturing Technology Division, Rock Island Arsenal, Illinois.

Powder metallurgy has been used to make metal articles approaching the physical properties, such as density and strength, of cast or wrought alloys of similar composition. In fact, powder metallurgy has been applied to stainless steel (see "Progress in Powder Metallurgy", Vol. 16, pp 120–129, 1960, Capital City Press, Montpelier, Va.). Although useful stainless steel articles have been made by the powder metallurgy technique, generally high compacting pressures and prolonged sintering at elevated temperatures have been found necessary in order to produce high density articles. Generally stainless steel articles commercially produced by powder metallurgy procedures have densities of 80–90 percent of theoretical density and interconnected porosity. These densities are not as high as desired and result in mechanical properties that are not as good as those of annealed wrought articles of similar composition, and the interconnected porosity increases their susceptibility to corrosion. Further, in order to obtain desired strengths, it generally has been necessary to coin or mechanically work the sintered stainless steel articles.

By further way of background of the prior art, mention should be made of U.S. Pat. No. 2,593,943 (Wainer) which discloses molding mixtures of metal powders with a heat-fugitive binder, the metal powders employed therein including powdered molybdenum, nickel, cobalt, and other metals, as well as mixtures of both a metal and an alloy. However, there is no teaching in this patent of sintering a powdered metal mixture of austenitic chromium-nickel stainless steel and exclusively a ferrite stabilizer such as molybdenum, to form an austenitic-ferritic chromium-nickel alloy of increased strength. U.S. Pat. No. 2,792,302 (Mott) discloses making sintered articles from 18–8 stainless steel using 10 to 15 weight % of a binder which can contain a relatively small amount of molybdenum disulfide as a die lubricant, which, upon subsequently being reduced during the sintering operation, has an insignificant effect, if any, on the properties of the sintered article. U.S. Pat. No. 3,223,523 (Adler) discloses a powder metallurgy technique in which stainless steel powder (AISI 302) is blended with an aqueous solution of a salt of molybdenum, copper, or nickel, such as ammonium molybdenate, which salt is reduced to form a metallic coating on the stainless steel powder, the amount of metallic coating being sufficient to improve the green strength of the powder compact and apparently less than that which would increase the strength of the resulting sintered article or change the finished properties thereof.

BRIEF DESCRIPTION OF THE INVENTION

Briefly, this invention provides a new alloy or steel, characterized as an unwrought chromium-nickel steel alloy, by sintering a mixture of powdered austenitic chromium-nickel stainless steel and powdered metal ferrite stabilizer, such as molybdenum, to form during sintering an austenitic-ferritic structure. This new alloy has a number of desirable properties and can be made in accordance with this invention with densities ranging from those which are relatively low to those which approach theoretical density, with strengths equaling or surpassing that of cast or wrought and annealed stainless steels of substantially the same elemental composition. These objects can be achieved by powder metallurgy techniques without resorting to specially produced powders, very high densification pressures and extremely high temperature sintering cycles of prolonged duration, or subsequent mechanical working and annealing operations. The low density products of this invention have particular utility as filter elements and the highly dense articles can be used, for example, in fabricating complex shapes that ordinarily would be cast, forged, or machined.

DETAILED DESCRIPTION OF THE INVENTION

The stainless steel powders used in this invention are commonly known in the art as austenitic chromium-nickel stainless steels, these alloys generally containing 16.0 to 26.0 wt. % chromium, 6.0 to 22.0 wt. % nickel, 0.03 to 0.25 wt. % (max.) carbon, and occasionally some other elements added to develope certain specific properties, such as 1.75 to 4.00 wt. % molybdenum or small amounts of titanium, tantalum, and niobium to minimize formation of chromium carbides, especially in welding. Standard types of these steels have been assigned numbers and specifications by the American Iron and Steel Institute. These are generally known in the art as stainless steels of the AISI 300 series, types 301, 302, 304, and 305 generally referred to as "18–8" stainless steel, and the "workhorse" type 316 generally referred to as "18–8-Mo". All of these AISI stainless steels of the 300 series are applicable in the practice of this invention. However, AISI 303 and 304 are preferred over grades such as AISI 316 and 317 because a greater amount of the ferrite stabilizer can be used without producing sintered articles with reduced ductility.

Powdered AISI stainless steels of the 300 series are commercially available in various grades or sizes and can be prepared by the atomization of molten metal. Generally, the powdered stainless steel used in this invention will have a mesh size of −50. In making highly dense articles, I prefer to use −325 mesh and in making less dense articles, I prefer to use −50+325 mesh, such as −200+325, −100+200, −50+100, or blends thereof, suitably selected to produce the desired micronic rating or bubble point, and, to that end, small amounts, e.g., 1–20 wt. %, of −325 mesh can be blended with the coarser powder, i.e., the −50+325 mesh. (The term "mesh" referred to herein means mesh size according to U.S. Standard Sieve.) Preferably, in the practice of this invention, the stainless steel powder is used in its alloyed form, sometimes referred to as being a "prealloy"; however, it is within the scope of this invention to use blends of the powdered individual metal elements in the same proportions found in the prealloyed steels since the amounts of the elemental metal constituents in the sintered articles will be equal to those found in prealloyed stainless steel.

The metal ferrite stabilizers used in this invention (in combination with the powdered austenitic chromium-nickel stainless steel) are a known class of materials, most of them having body centered, cubic crystal form. They are distinguished from the austenite stabilizers, such as nickel and cobalt, which do not produce the desired results, such as high density, when used in a similar fashion in the practice of this invention, even when used in fine particle size (1.2 – 3 microns) at a level of 6 weight percent. The ferrite stabilizers used in this invention include molybdenum, titanium, vanadium, tungsten, chromium, zirconium, silicon, tantalum, and niobium. It is also within the scope of this invention to use combinations in the form of mixtures of alloys of two or more of these stabilizers, such as molybdenum-tungsten combination, or a molybdenum-vanadium combination. The amount of stabilizer used will depend upon the particular stabilizer to be used and the properties desired in the subsequently sintered article. Generally, the amount of stabilizer blended with the powdered stainless steel will be that amount, functionally expressed, sufficient to impart a desirably high tensile or yield strength without undesirably imparting brittleness to the article. The particular stabilizer to be used and the amount thereof can be determined by those skilled in the art in possession of this disclosure by simple routine tests involving correlating various levels of stabilizer with the mechanical properties of the corresponding sintered articles. Generally, the amount of stabilizers used will amount to 1 to 11 weight percent, based on the total weight of the blend of powdered stainless steel and powdered ferrite stabilizer. Generally, low amounts do not impart the desired increase in strength and fast sintering rate, and high amounts will result in brittleness of the sintered article. In the case of the stronger ferrite stabilizers, such as silicon and zirconium, amounts of 1 to 3 weight percent may be sufficient to achieve the desired results. In the case of chromium, tungsten, titanium, and vanadium, these stabilizers are preferably used in amounts of 3 to 9 weight percent, and molybdenum is preferably used in amounts of 5 to 7 weight percent.

The mesh of the powdered ferrite stabilizer can vary from relatively coarse to relatively fine, but fine mesh of −325 is preferred because of the greater distribution of the resulting ferrite in the grain boundaries. The size of the ferrite stabilizer powder is preferably expressed in terms of the Fisher Standard Subsieve Series. Generally, powdered ferrite stabilizer having Fisher Numbers in the range 0.5 to 44 microns will be applicable, though that in the range of 2 to 10 microns is preferred. It is also within the scope of this invention to use reducible oxides, hydrides, and, less desirably, salts of such ferrite stabilizers, since such precursors will be reduced during sintering to the metal. Such salts include the nitrates, sulfates, acetates, halides such as chlorides and bromides, and the like, as well as ammonium molybdate.

The blended mixture of the austenitic stainless steel powder with the powdered ferrite stabilizer can be deposited in the form of a loose powder on a suitable substate or in a suitable mold, as in the case of slip casting, and sintered to form a rigid sintered article. Alternatively, the blended powdered mixture can be compacted or pressed to form a shaped article which is then sintered.

Where organic heat-fugitive binders are used to form a shaped article, binders of the nature disclosed in U.S. Pat. Nos. 2,593,943, 2,709,651, and 2,902,363 can be employed, such as methylcellulose. Various solvents can be used in conjunction with these binders, such as water, as well as various plasticizers, such as glycerin. Useful die lubricants which can also be used include stearic acid, and zinc, calcium, and lithium stearates. Where organic materials or adjuncts are blended with the mixture of powdered stainless steel or ferrite stabilizer, the resulting shaped articles can be dried or slowly heated prior to sintering, or even partially sintered, e.g., at 1050°–1200°C., in a reducing atmosphere, in order to volatilize, burn-off, and/or decompose the organic material, taking suitable precautions to minimize any carbon from being left in the sintered article.

The blending of powdered stainless steel, powdered ferrite stabilizers, and binders and other various adjuncts where used, can be carried out in a conventional manner in various types of commercially available mixers, tumblers, blenders, rotating drums, and the like, care being taken to insure that the blend is homogeneous and the components well-dispersed. Where a binder is used, the blend will be in the nature of a plastic mass, dough, or clay, and can be shaped and dried, for example, on a rolling mill or by means of extrusion, injection molding, etc. The shaped article can then be compacted under pressure, if desired, before sintering.

Compacting of the blended powdered mixture, either as a dry mixture or as a dough, or even after partially sintering a dough to burn-off organic binder, can also be carried out in a conventional manner, using either hot or cold pressing, such as die pressing, isostatic pressing, etc., the compacting pressures range from 4,000 to 200,000 psi. Actually, the high compacting pressures normally used in compacting powdered stainless steel will not be required in the practice of this invention in order to obtain desirably high strength and density in the sintered article, and thus the longevity of die parts, etc., will be far greater, with the attendant cost savings. In fact, the desired objects of this invention can be readily achieved with low compacting pressures in the range of 20,000 to 50,000 psi.

Shrinkage of the shaped articles upon sintering will occur, as it does in conventional powder metallurgy, and this should be compensated for by making the article to be sintered with oversize dimensions, etc. Generally, linear shrinkage will be 1 to 25%.

The sintering step of this invention will be generally carried out at sufficiently high temperatures and have sufficient duration to achieve at least during the sintering step the austenite-ferrite structure and the desired increased tensile strength in the sintered article. Generally, the sintering temperature will be below that at which any melting of the metal powders occur. Sintering temperatures useful in the practice of this invention will be generally in the range of 1200° to 1400°C., and preferably from 1250° to 1350°C., this latter preferred temperature range being the range where the ferrite phase is readily formed. The duration of sintering will vary and can be from 10 minutes to 2 or 3 hours or longer. In any event, the sintering temperature will be sufficiently high and of sufficient duration to cause the formation of two-phase austenite-ferrite microstructure. The sintering operation is carried out in a conventional reducing atmosphere or under vacuum or in an inert gas such as argon. The reducing atmospheres particularly useful include hydrogen and anhydrous or cracked ammonia, the dew points of these gases being − 40°F. or lower. The sintering furnaces which can be used include the conventional resistance or induction heated gas-tight shell or muffle furnace of the pusher, hump, or batch types. After sintering, the sintered articles are preferably rapidly cooled through the region where the ferrite phase is partially unstable, so as to minimize rejection of ferrite formers and maintain the ferrite formed during the sintering operation. The rate of cooling necessary to retain the ferrite formed during sintering can be determined empirically by simple routine cooling tests by those skilled in the art. Means for effecting the rapid cooling necessary to preserve the ferrite phase, or at least 50 to 95 volume percent of that formed during sintering, are available in the art, such cooling being carried out by quenching sintered articles from their sintering temperatures in cooled furnace gas, other gas such as argon or nitrogen, air, water, oil, or the like. Slow cooling, such as furnace cooling, of the sintered articles can be employed but generally is not preferred since this favors the formation of sigma and related undesired phases, which impart brittleness and other generally undesirable properties to the sintered article. However, slow cooling can be used in those instances where the presence of these normally deleterious phases is desired or is of no consequence.

The microstructure of the preferred sintered articles of this invention is substantially two-phased: austenite and ferrite. Other phases, namely sigma and/or related phases, may be present if the sintered article is slowly cooled as described above. The austenite-ferrite two-phase structures can be heated further at higher sintering temperatures very near the melting point of the structure to form structures which are substantially all ferritic, or, by appropriate heat treatment, the two-phase structures can be transformed into substantially all austenitic structure. These essentially single-phase structures, however, will revert to the two-phase austenite-ferrite structure if reheated to temperatures, e.g., 1250°–1350°C., favoring their coexistence. In any event, in order to produce sintered articles having desired properties, such as strength and density, it is essential in this invention to sinter at the temperature where the two-phase structure exists, regardless of whether it is destroyed or retained by further heating at higher or lower temperatures or upon cooling. That is, these desirable properties are not dependent on the existence of the two-phase structure in the cooled, sintered article, but are dependent on a sintering step where such two-phase structure is formed. However, in the case of single phase ferritic structures, these will exhibit reduced ductility and toughness and reduced corrosion resistance to salt solution, i.e. sea water.

Generally, at sintering temperatures favoring such two-phase structure or at ambient temperatures where such two-phase structure is retained, the ferrite phase will comprise 4 to 80 volume percent, preferably 10 to 60 volume percent, and the balance will be substantially austenite.

The presence of the ferrite phase results in a faster rate of sintering due to the increased diffusion rate of this phase and it imparts magnetism to the sintered article. The grains of austenite and ferrite are randomly distributed and the grain size of these phases in the sintered article is relatively fine, e.g., 5–8 according to ASTM E19–33, and is in contrast to the relatively coarse grain of prior art sintered stainless steel caused by the costly long high sintering temperatures necessary to obtain dense articles.

X-ray studies of quenched sintered articles of this invention show, for example, face centered, cubic (FCC) diffraction lines, attributed to austenite, with a relative intensity of about 100, and body centered cubic (BCC) diffraction lines, attributed to ferrite, with a relative intensity of 70. Slow or furnace cooling of such sintered articles showing FCC relative line intensity of 100 and BCC relative line intensity of 20, and two very weak lines attributed to sigma phase.

Rapidly cooled specimens when viewed under an optical microscope show microstructure characterized as grains of austenite dispersed in an essentially continous matrix that was ferrite during sintering but has transformed at least partially to a very fine mixture of austenite and ferrite during cooling from the sintering temperature. Where a relatively large amount, e.g. 9%, of the molybdenum stabilizer is used, the grains of austenite will be needlelike or lenticular, and where a relatively small amount of molybdenum (e.g., 3%) is used, the grains of austenite will be irregular equiaxed in shape. Low temperature sintering, e.g., 1250°C., tends to reduce the amount of ferrite and produces irregular equiaxed austenite grains; at high sintering temperatures, e.g., 1350°C., the amount of austenite decreases and the grains of austenite appear lenticular or needle-like.

Most importantly, the tensile strength of the sintered article will be significantly greater than that obtained by sintering powdered stainless steel of the AISI 300 series in the absence of ferrite stabilizers. Dense sintered articles of this invention made with −325 mesh austenitic stainless steel powder (and ferrite stabilizer) will have "as sintered" ASTM E8–66 tensile strengths as high as 55,000–80,000 psi, and even as high as 110,000 psi, these values being as much as 25 to 200% greater than those obtained by sintering stainless steel powder without ferrite stabilizer addition. The sintered articles of this invention also have very high yield strengths, a property of considerable importance to structural designers. Yield strength is usually defined as the stress required to impart a permanent deformation of 0.2% in the article. Dense sintered articles of this invention prepared from −325 mesh austenitic stainless steel powder (and ferrit stabilizer) will have ASTM E8–66 yield strengths "as sintered" as high as 25,000 to 80,000 psi, which values are 50–400% higher than that of "as sintered" stainless steel articles of similar composition produced by powder metallurgy (without ferrite stabilizer). These high yield strengths even substantially exceed that obtained by annealed wrought stainless steel of similar composition.

The apparent density of the dense sintered articles will also be significantly greater (e.g., 5–25% greater) and generally will be in a range of 85 to 95+% of the theoretical density (as sintered), as determined by mercury porousimetry described by the American Instrument Co. in its Bulletin 2300 (1960).

In the case of the porous sintered articles of this invention, the "as sintered" tensile strength and absolute micronic rating values of the sintered articles can be multiplied to obtain a product value which is useful as a parameter for evaluating the mechanical properties of the articles without reference to the particle size of the stainless steel powder used in preparing them. For example, a tensile strength of 17,475 psi. multiplied by an absolute micronic rating of 14 microns, gives a product value or parameter of 244,650. The parameter values of the porous articles of this invention will be as high as 200,000 to 500,000, and as much as 90 to 450% higher than that of porous articles made of sintered stainless steel powder without ferrite stabilizer addition.

Where reference is made to "as sintered" values, this means the value of the article after sintering and cooling to room temperature and prior to any subsequent or post treatment, such as mechanical working and annealing.

As far as known, the desirably high strengths and/or densities of the articles of this invention can be obtained in the prior art only by repeatedly cold working and annealing stainless steel of the cast type obtained by liquid metallurgy, or by prior art powder metallurgy techniques involving significantly greater compacting or pressing pressures and long high temperature sintering and subjection of the sintered article to subsequent repeated cold working and annealing.

The novel alloy of this invention can be used in manufacturing articles of either a relatively low density or porous nature, which would be particularly suitable where the sintered articles are used to filter elements, or relatively dense articles having densities approaching theoretical densities. Such high densities are particularly suitable in the fabrication of such articles as die pressed or injection molded parts, such as a cam, valve housing, etc., seamless tubing for heat exchangers and immersion heaters, corrugated recuperative or regenerative heat exchangers (made without welding or brazing). The dense shaped articles can also be used for architectural applications such as window casings and decorative railing supports, burner grids of corrugated or foamed structure, acoustic materials made as a foamed structure, catalyst carrier and catalyst support structures, dinnerware, etc. Dense sintered articles of this invention can be made highly impervious, for example, by injection molding, such articles being advantageously employed in applications where leakage or corrosion would present problems if relatively porous sintered stainless steel were used. It is also within the scope of this invention to subject the sintered articles to finishing operations which result in even denser articles or better mechanical properties, such operations including, for example, coining and resintering. However, the "as sintered" articles in most cases will have the properties desired and further processing will be unnecessary though useful in some cases to achieve final dimensional tolerances.

EXAMPLES

The objects and advantages of this invention are further illustrated by the following examples, but the particular materials and amounts thereof recited in these examples, as well as other conditions and details, should not be construed to unduly limit this invention.

EXAMPLE 1

Two batches of powdered metal were made using −325 mesh prealloyed powdered stainless steel of the AISI 316L type, one batch being made in accordance with this invention using 3 weight % powdered molybdenum with a Fisher Number of 3.27 microns. In each batch, 100 g. of the powdered material were mixed with 3 g. of methyl cellulose (4,000 cps) in a twin shell blender for 1 hr. and then for about 20 min. in a sigmal blade mixer with 9.5 cc. of 16.6 wt. % solution of glycerin in distilled water until a stiff clay or plastic mass was produced. The wet clay was then rolled to a 0.060 inch thick sheet on a rubber mill with a roll speed ratio of 1.4:1. The sheets were cut into specimens 1 × 2 inches, placed in a vacuum drying oven and dried at 115°F. The specimens were then pressed at 20,000 psi and sintered in a vacuum furnace by heating from room temperature to 350°C. in about 3 hrs. and then heating to 1325°C. and holding for 8 hrs., the samples being suspended in −100 mesh alumina during sintering and furnace cooled (7.34°C./min. over 1300°–600°C.). In Table I below, the results of these two runs are shown. Metallographic mounts of the sintered specimens were etched with ferric chloride. In estimating the amounts of the phases, light-appearing grains were considered austenite and the relatively darker matrix was considered as mixed grains of austenite (light) and ferrite (dark) which was considered all ferrite at sintering temperature.

TABLE I

| Amt. of Mo in 316L-Mo blend, wt.% | Green density of rolled,dried sheet before pressing, g/cc. | Sintered density, g/cc | % of theo. density | Microstructure of specimen at sintering temperature |
|---|---|---|---|---|
| 0 | 3.83 | 6.13 | 76.8 | austenite |
| 3 | 3.70 | 7.24 | 89.8 | 94 vol. % austenite 6 vol. % ferrite |

These data show that the use of ferrite stabilizer results in a sintered article having a significantly greater density and causes the formation of a two-phase microstructure of austenite and ferrite.

EXAMPLE 2

In this example, a series of six runs was made in which compacted mixtures of stainless steel of AISI 303 type and varying amounts of molybdenum (Fisher Number 3.27 microns) were sintered and furnace cooled. The compacting, sintering, and cooling procedures and microstructure evaluation used were the same as that of Example 1. For comparison purposes, another run was made in a similar fashion without the use of molybdenum. Results of this series of runs are shown in Table II below.

TABLE II

| Amt. of Mo in 303-Mo blend,wt.% | Pressed green density, g/cc | Sintered density, g/cc | Vickers Diamond pyramid hardness, 100 g load | Microstructure of sintered article, vol. % Austenite | Ferrite |
|---|---|---|---|---|---|
| 0 | 4.58 | 6.35 | 246 | 100 | 0 |
| 1 | 4.34 | 6.44 | 216 | 100 | 0 |
| 3 | 4.46 | 6.43 | 234 | 100 | 0 |
| 5 | 4.48 | 6.79 | 353 | 91.6 | 9.4 |
| 7 | 4.56 | 7.67 | 460–981 | 79.2 | 20.8 |
| 9 | 4.46 | 7.95 | 359–866 | 68 | 32 |
| 11 | 4.42 | 7.58 | 485–877 | 56 | 44 |

The data of Table II show that the enhancement in density obtained by the ferrite stabilizer is associated with increased hardness and the formation of the two-phase microstructure.

EXAMPLE 3

One thousand g. of −325 mesh AISI 316L powder, 30 g. of molybdenum of a 2.4 micron Fisher Number, and 50 g. of methylcellulose (4000 cps) were dry blended for 1 hr. To this was added 110 cc of 10% aqueous solution of glycerin in distilled water. The batch was mixed to a clay-like consistency in a sigma blade mixer and the batch was rolled into sheet and pressed. Blanks were cut from the sheet and these were sintered in a hydrogen atmosphere for 4 hrs. at 1315°C. The specimens were water quenched from 1300°C. and mechanical tests were performed. The carbon content after sintering averaged 0.06 wt. %. Table II summarized the results.

TABLE III

| Run* | Green pressing pressure, psi | Strength** of sintered specimens, psi. 0.2% offset yield | Ultimate | Elongation,% | Density of Sintered specimen Apparent | Real |
|---|---|---|---|---|---|---|
| 1 | 30,000 | 41,800 | 80,620 | 39.6 | 7.62 | 7.66 |
| 2 | 4,000 | 40,430 | 79,027 | 34.4 | 7.32 | 7.39 |

*Values shown for each run are averages of 3 specimens.
**Strengths were determined according to ASTM E8-66, using pin loaded specimens 1" gauge length and ¼" width.

The data of Table III show that high strengths and densities can be obtained with desirable elongation. The values shown for these properties are considerably better than what is now commercially achieved in powder metallurgy and compare very well with many wrought austenitic stainless steels in the annealed condition. The closeness of the apparent and real density values show that the connected porosity in the specimens is very minor.

EXAMPLE 4

In this example, a series of runs was made in which compacts of −325 mesh AISI 304L or AISI 316L stainless steels dry blended with varying amounts of molybdenum (Fisher No. 4.2 microns) were pressed at 20,000 psi and sintered at various temperatures for various periods of time in dry hydrogen and rapidly cooled (110°C./min.) and the properties of the green compacts and sintered articles determined and compared. For purpose of comparison, other runs were made in which stainless steel compacts made without molybdenum addition were prepared and sintered under these varying conditions. Results are summarized in Table IV.

TABLE IV

| | Runs[d] 1 | 2 | 3 | 4 | 5 | 6 | 7 | 8 |
|---|---|---|---|---|---|---|---|---|
| Stainless steel used | 304L | 304L | 304L | 304L | 304L | 304L | 316L | 316L |
| Amt. of Mo in blend, wt. % | 0 | 3 | 6 | 9 | 0 | 6 | 0 | 3 |
| Sintering,time,hrs. | 2 | 2 | 2 | 2 | 1.25 | 1.25 | 2 | 2 |

TABLE IV-continued

| | Runs[d] 1 | 2 | 3 | 4 | 5 | 6 | 7 | 8 |
|---|---|---|---|---|---|---|---|---|
| temp.,°C. | 1250 | 1250 | 1250 | 1250 | 1300 | 1300 | 1350 | 1350 |
| Densities | | | | | | | | |
| green,g/cc | 5.09 | 5.14 | 5.17 | 5.28 | 5.08 | 5.20 | 5.56 | 5.59 |
| sintered,g/cc | 6.33 | 6.84 | 7.38 | 7.50 | 6.57 | 7.58 | 6.72 | 7.43 |
| % of theo. | 79.4 | 85.0 | 91.0 | 91.8 | 82.4 | 93.4 | 84.2 | 92.3 |
| Strengths[a], | | | | | | | | |
| 0.2% offset | | | | | | | | |
| yield,KSI | 19.4 | 29.6 | 37.9 | — | 21.7 | 58.5 | 17.9 | 30.0 |
| ultimate,KSI | 33.5 | 57.0 | 81.0 | 86.0 | 50.4 | 95.6 | 43.3 | 64.4 |
| Hardness,Vickers | | | | | | | | |
| Diamond pyramide[b] | 68 | 122 | 130 | 271 | 80 | 216 | 69 | 119 |
| Elongation[a], % | 15 | 20.3 | 7.0 | 2.0 | 25.9 | 19.5 | 25.0 | 16.5 |
| Phases[e] | | | | | | | | |
| austenite,vol.% | 100 | 78 | 60 | 20 | 95.6 | 60 | 96 | 90 |
| ferrite,vol.% | 0 | 22 | 40 | 80 | 4.4 | 40 | 4 | 10 |
| Grain size of phases[c] | | | | | | | | |
| austenite | 6 | 6 | 7 | 8 | 6 | 8 | 5 | 5 |
| ferrite | 8 | 8 | 7 | 8 | 8 | 8 | 8 | 8 |

a — Specimens for tensile strength tests were made with a Haller DL-1001 die and tested on an Instron machine, following ASTM E8-66 and MPIF 10-63.
b — Using 10 kg load.
c — ASTM E19-33 (smallest size on chart is 8).
d — Value shown for each run is an average of 3-6 specimens.
e — Microstructure evaluations were made as described in Ex. 1.

The data of Table IV show again the increase in density and strengths obtained through the use of ferrite stabilizer. In addition, the data show that in general these values increase with increasing molybdenum content, though elongation of the sintered article falls off with higher amounts of molybdenum addition. The data also show that higher sintering temperatures, at the same level of molybdenum addition, give higher densities, strengths, and hardnesses. I have also found that longer sintering times at a given sintering temperature will give higher values.

EXAMPLE 5

In this example, a series of runs was made in which various ferrite stabilizers were blended with AISI 304L stainless steel, the blends compacted, sintered, and rapidly cooled. The stainless steel powder had a mesh size of −325. All of the stabilizers were used in elemental powder form except for the titanium, vanadium, and zirconium stabilizers, which were used as hydrides. For purposes of comparison, runs were also made with nickel and cobalt additions. The sizes of the ferrite stabilizers used are shown in Table V.

TABLE V

| Powder | Size |
|---|---|
| Mo | 2–4 microns* |
| Cr | 3 microns |

TABLE V-continued

| Powder | Size |
|---|---|
| W | 0.9 microns |
| $TiH_2$ | 6–9 microns |
| $ZrH_2$ | 2–8 microns |
| Co | 1.2 microns |
| Ni | 3–5 microns |
| $VH_2$ | −325 mesh** |
| Si | −325 mesh |

*Fisher Standard Subsieve Series
**U.S.Standard Series

The powdered materials were blended in a twin shell blender for about 30 min. Those sintered articles whose tensile strengths were determined were made from compacts prepared by pressing the blended powders in a Haller DL-1001 die in accordance with ASTM E8–66 and MPIF 10–63, these specimens having been pressed at 20 tsi before sintering. All sintering was performed at sintering temperatures of 1300°C. for 1.25 hrs. (except in Runs 3, 12, and 13, where sintering was at 1350°C. for 2 hrs.), in a palladium-silver purified hydrogen atmosphere using induction heating. The sintered articles were rapidly cooled in the furnace. The results are summarized in Table VI.

TABLE VI

| Run | Ferrite stabilizer(s) used and amt. thereof, wt. % of blend | Density, % of theoretical Green (±0.5 max.) | Sintered ±1.0 (max.) | Elongation, % | Strength (KSI) 0.2% offset yield | Ultimate |
|---|---|---|---|---|---|---|
| 1 | none | 63.6 | 82.4 | 25.9 | 21.7 | 50.4 |
| 2 | 6% Mo | 64.1 | 93.7 | 18.3 | 55.2 | 98.6 |
| 3 | 6% Mo | 64.9 | 95.0 | 22.3 | 53.4 | 105.0 |
| 4 | 6% Cr | 68.2 | 94.8 | 22.5 | 45.3 | 82.7 |
| 5 | 4% Si | 61.4 | 93.5 | 4.1 | 78.2 | 96.8 |
| 6 | 6% W | 68.0 | 86.8 | 25.0 | 40.9 | 78.8 |
| 7 | 3% Vi | 63.0 | 94.0 | 28.0 | 46.9 | 83.2 |
| 8 | 3% $TiH_2$ | 63.1 | 88.2 | 7.1 | 43.6 | 66.5 |
| 9 | 3% $ZrH_2$ | 63.9 | 94.2 | — | — | — |
| 10 | 3% Mo + 1.5% $VH_2$ | 63.8 | 93.2 | 30.1 | 49.3 | 88.6 |
| 11 | 3% Mo + 1.5% $TiH_2$ | 63.6 | 89.0 | 9.3 | 44.0 | 70.4 |
| 12 | 6% Ni | 64.2 | 85.5 | 36.7 | 19.7 | 53.0 |
| 13 | 6% Co | 64.4 | 85.8 | 37.8 | 21.9 | 67.9 |

The above data show the applicability of a host of ferrite stabilizers in the practice of this invention as well as combinations thereof, and also show that Ni and Co, by comparison, are inferior.

EXAMPLE 6

Following the procedure of Example 5, a compact was made and sintered from a blend of elemental metals used in amounts matching with the composition of AISI 304L. In one run, the blend contained 6 wt. % of powdered molybdenum and the compact prepared from this blend had a green density of 70% that of the theoretical density, the sintered density of this compact being 87.4% of theoretical. The compact made from the blend without molybdenum addition had a comparable green density of 70.9% of theoretical but by contrast the sintered density of this compact was only 81.5% of theoretical. The sintered article made with molybdenum had an 0.2% yield of 47.1 KSI, an ultimate strength of 56.1 KSI, and an elongation of 2.5%. The sintered article made without molybdenum had an 0.2% offset yield of 22.0 KSI, an ultimate strength of 38.3 KSI, and an elongation of 10%.

EXAMPLE 7

Two dough batches of stainless steel powder (AISI 304L) of the following composition were prepared:

Batch 1

1000 g. 304L stainless steel,
50 g. Methylcellulose* (4000 cps.)
120 cc 5% solution of glycerin in water Batch 2

1000 g. 304L stainless steel,
60 g. Molybdenum,
56 g. Methylcellulose * (4000 cps.)
120 cc 5% solution of glycerin in water

*In place of methylcellulose, other binders can be used, such as polypropylene, polystyrene, stearin mixed with vegetable oil, etc.

In preparing Batch 1, the stainless steel and methylcelluose were blended in a sigma blade mixer for about 30 min. and then the glycerin-water solvent was added. The material was mixed into a clay-like consistency under a vacuum of about 29 inches of mercury. The clay-like material was added to a Frobring Mini-Jector injection molding machine (Model 70VC100) and the clay was injected in a flat bar configuration. Batch 2 was handled in an identical manner except that the molybdenum addition was blended with the stainless steel using a V-shell blender and an intensifier rod prior to adding the powder to the sigma blade mixer. The injection molded bars of both batches were weighed and measured in the green or injected state. The green density of Batch 1 was 4.189 g/cc and that of Batch 2 was 4.127 g/cc. Specimens from both batches were placed in a hydrogen furnace and heated from room temperature to 1310°C. in 12 hrs. The specimens were held at temperature for 2 hrs. After sintering, the densities of the specimens were determined using a mercury porosimeter. Carbon content was also determined. Results are summarized in Table VII.

TABLE VII

| Batch No. | Apparent density, g/cc | Apparent Porosity*, % | % of theo density | Carbon content wt. % |
|---|---|---|---|---|
| 1 | 6.28 | 19.04 | 80.6 | 0.7 |
| 2 | 7.68 | 0 | 94.7 | 0.05 |

*Apparent porosity is based on volume change exhibited by specimen when subjected to mercury pressure of 3000 psig (see Bulletin 2300, Amer. Inst. Co.).

The data of Table VII show that the addition of molybdenum significantly aided the sintering process and allowed the production of dense impermeable parts by injection molding. Heretofore it has been necessary to cast or machine stainless steel bar to obtain dense complex parts. The subject invention now makes it possible to produce complex, dense, strong parts in stainless steel by injection molding without resorting to the more expensive process of machining or the process of molten metal casting.

EXAMPLE 8

Six batches of various commercial grades of stainless steel powder were prepared, some of which were blended with powdered molybdenum (Fisher Number 4.2 microns).

Two hundred g of each batch were blended with 10 g. of methylcellulose and then with 35–45 cc. of 10% aqueous solution of glycerin, and each batch was converted into a clay-like material. This material was then rolled using a rubber mill to produce sheet. The green sheet was sintered in hydrogen by heating from room temperature to 1350°C. in 12 hrs. and holding at 1350°C. for 2 hrs., and furnace cooled. The resulting sintered sheets were cut into suitable specimens for flow, bubble point, and tensile testing. These runs and the results obtained are summarized in Table VIII.

TABLE VIII

| | Runs 1 | 2 | 3 | 4 | 5 | 6 |
|---|---|---|---|---|---|---|
| Stainless steel used | 316L | 316L | 316L | 316L | 316L | 316L |
| Mesh | −50+100 | −50+100 | −100+200 | −100+200 | −200+325 | −200+325 |
| Amt. of Mo in blend, wt. % | 0 | 5 | 0 | 5 | 0 | 5 |
| Pressure (cm. $H_2O$) to produce following air flows through specimen: | | | | | | |
| 37 CFH | 2.2 | 3.3 | 5.7 | 12.3 | 33.2 | 204 |
| 74 CFH | 5.0 | 7.9 | 13.0 | 28.7 | 71.2 | 397 |
| 111 CFH | 9.3 | 12.9 | 20.5 | 45.9 | 106 | 730 |
| 148 CFH | 13.7 | 18.7 | 39 | 66.8 | 143.6 | — |
| Strengths*: | | | | | | |
| 0.2% Offset yield, psi | — | 4250 | 1400 | 10,075 | 4466 | 12,400 |
| Ultimate, psi | 900 | 5050 | 1825 | 11,200 | 6325 | 17,475 |
| Apparent density | 39 | 46 | 44 | 54 | 50 | 70 |
| Bubble point (ΔP req to burst bubble)** cm. $H_2O$ | 8.4 | 8.6 | 13.8 | 16.2 | 30.8 | 40.3 |

TABLE VIII-continued

| | Runs 1 | 2 | 3 | 4 | 5 | 6 |
|---|---|---|---|---|---|---|
| Absolute micronic rating**, microns | 72 | 70 | 43 | 38 | 20 | 14 |
| Parameter*** | 64,800 | 353,500 | 78,473 | 425,600 | 126,500 | 244,650 |

*Specimens for tensile strength were made from flat 1" gauge length and tested (as in Ex. 3) at room temperature using a loading rate of 0.5 cm/min. Values shown are averages of 4 runs.
**Specimens were tested for bubble point according to MIL-F-8815B, except that specimens were not rotated, and the absolute micronic rating was determined therefrom by dividing the bubble point into the conversion factor of 605.
***Parameter is the product of ultimate strength multiplied by absolute micronic rating.

The significance of the data of Table VIII can be further demonstrated by plotting the values for the various properties of the sintered articles made with and without molybdenum addition. For example, if the strengths of the sintered specimens are plotted as a function of the absolute micronic rating using a simple linear plot and linear extrapolation between data points, the plot will show that a porous membrane with an absolute micronic rating of 40 microns would be 320% stronger if molybdenum addition is used in accordance with this invention. A plot of strength versus density will show that, for any given density, the structure made in accordance with this invention, using molybdenum addition, will be stronger. For example, at a density of 48% of theoretical, the structure made with molybdenum addition is 42% stronger.

EXAMPLE 9

Two 3000 g. batches of AISI 316L (−100+200 mesh) were prepared in a manner like Example 8, one of these batches containing 5 wt. % molybdenum (Fisher Number 4.2 microns). The batches of clay were extruded to form 4-foot long tubes with an outside diameter of 0.504 inch and an inside diameter of 0.314 inch. The green tubes were sintered in dry hydrogen for 3 hrs. at 1150°C. to burn-off the binder and partially sinter the tubes. The tubes were then isostatically pressed and resintered at 1350°C. for 2 hrs. in dry hydrogen. The tubes were furnace cooled to form porous tube useful as filter elements. The tubes were machined to form tensile specimens and the ultimate tensile strengths were determined. These runs and results are summarized in Table IX.

TABLE IX

| Run | Amt. of Mo blended with 316L, wt. % | Isostatic compaction pressure, psi | Density of sintered tube, % of theo. | Ultimate tensile strength of sintered tube, psi |
|---|---|---|---|---|
| 1 | 0 | 40,000 | 66.1 | 11,900 |
| 2 | 5 | 30,000 | 71.7 | 24,100 |

These data show the tube formed in accordance with this invention had a strength 100% greater than the tube formed without molybdenum addition, even though the partially sintered compact wasn't isostatically pressed to as high a pressure as the control.

Various modifications and alterations of this invention will become apparent to those skilled in the art without departing from the scope and spirit of this invention, and it should be understood that this invention is not to be unduly limited to the illustrative embodiment set forth herein.

I claim:

1. A process comprising blending powdered austenitic chromium-nickel stainless steel, or powdered elemental constituents thereof, with powdered ferrite stabilizer or reducible precursors thereof, and sintering the resulting blend to produce an austenitic-ferrite chromium nickel alloy.

2. A process comprising blending powdered austenitic chromium-nickel stainless steel of the AISI 300 series with powdered ferrite stabilizer, sintering the resulting blend in loose or compacted form in a reducing atmosphere, and cooling the resulting sintered article, the amount of said ferrite stabilizer in said blend and conditions of sintering being sufficient to form a two-phase austenitic ferritic alloy which in its "as sintered" state has increased strength and/or density.

3. The process according to claim 2, wherein said ferrite stabilizer is selected from the group consisting of molybdenum, titanium, vanadium, tungsten, chromium, zirconium, silicon, tantalum, and combinations thereof.

4. The process according to claim 2, wherein the amount of said ferrite stabilizer is 1 to 11 weight percent by weight of said blend.

5. The process according to claim 2, wherein the amount of said ferrite stabilizer is about 3 to 9 weight percent by weight of said blend and is titanium, vanadium, tungsten, or chromium.

6. The process according to claim 2, wherein said ferrite stabilizer is molybdenum and the amount thereof is about 5 to 7 weight percent by weight of said blend.

7. The process according to claim 2, wherein said sintering is carried out at 1200° to 1400°C.

8. The process according to claim 2, wherein said sintering is carried out at 1250° to 1350°C.

9. The process according to claim 2, wherein said cooling of said sintered article is carried out at a sufficiently rapid rate to substantially retain in the cooled sintered article the two-phase austenite-ferrite formed during sintering.

10. The process according to claim 2, wherein said stainless steel powder is AISI 304L or AISI 316L.

11. The process according to claim 2, wherein said stainless steel powder is −50+325 mesh and said ferrite stabilizer has Fisher Numbers of 0.5 to 10 microns.

12. The process according to claim 2, wherein said stainless steel powder and said ferrite stabilizer are −325 mesh.

13. The process according to claim 2, wherein said two-phase alloy comprises 10 to 60 volume percent ferrite and 90 to 40 volume percent austenite.

14. The process according to claim 2, wherein said stainless steel powder has −325 mesh and said alloy produced by said process has "as sintered" ultimate tensile strengths of 55,000 to 110,000 psi, 0.2% offset yield strengths of 25,000 to 80,000 psi, and apparent densities of 85 to 99+% of theoretical.

15. The process according to claim 2, wherein said stainless steel powder has −50+350 mesh and said alloy produced by said process has tensile strength and absolute micronic rating values whose product is in the range as high as 200,000 to 500,000.

16. The process according to claim 2, wherein said blend is compacted before sintering.

17. The process according to claim 2, wherein said blend is mixed with an organic heat-fugitive binder to form a shaped plastic mass which is heated in a reducing atmosphere at 1050°–1200°C. to burn off said organic binder and the resulting partially sintered article is compacted to desired dimensions and tolerances and then subjected to said sintering step and sintered at 1250° to 1350°C.

18. The process according to claim 2, wherein said blend is mixed with an organic heat-fugitive binder to form a plastic mass which is injection molded, extruded, or rolled to form a shaped article and the latter is then subjected to said sintering step.

19. A process for producing an unwrought, sintered chromium-nickel stainless steel, which comprises blending powdered austenitic chromium-nickel stainless steel of the AISI 300 series with 1 to 11 weight percent of powdered ferrite stabilizer having Fisher Numbers of 0.5 to 10 microns and selected from the group consisting of molybdenum, titanium, vanadium, tungsten, chromium, zirconium, silicon, tantalum, and mixtures thereof, shaping the resulting blend to produce a green shaped article, sintering said green shaped article in a reducing atmosphere at 1250 to 1350°C. for a sufficient time to produce a two-phase structure comprising 10 to 60 volume percent ferrite and 90 to 40 volume percent austenite, and cooling the resulting article to produce a product having increased strength and density.

20. The process according to claim 19 wherein said ferrite stabilizer is molybdenum which amounts to 5 to 7 weight percent by weight of said blend.

21. The process according to claim 19, wherein said stainless steel powder has a mesh size of −325 and said product has "as sintered" tensile strength in the range of 55,000 to 110,000 psi, 0.2% offset yield strength in the range of 25,000 to 80,000 psi, and apparent density in the range of 85 to 99+% of theoretical.

22. The process according to claim 19, wherein said stainless steel powder has a mesh size of −50+325 mesh and said product has a tensile strength and absolute micronic rating values whose product is in the range of 200,000 to 500,000.

23. The process according to claim 19, wherein said sintered article is rapidly cooled at a rate sufficient to substantially retain said two-phase structure.

24. The process according to claim 19 wherein said blend of powdered stainless steel and ferrite stabilizer is mixed with an organic heat-fugitive binder and the resulting green shaped article is heated to burn off said organic binder prior to said step of sintering.

* * * * *

UNITED STATES PATENT AND TRADEMARK OFFICE

CERTIFICATE OF CORRECTION

PATENT NO. : 3,940,269

DATED : February 24, 1976

INVENTOR(S) : Theodore R. Bergstrom

It is certified that error appears in the above-identified patent and that said Letters Patent are hereby corrected as shown below:

Column 3, line 55, "of alloys" should read -- or alloys --;

Column 3, line 55, "as" should be followed by -- a --;

Column 8, line 46, "sigmal" should read -- sigma --;

Column 12, line 61, "3% Vi" should read -- 3% V --.

Signed and Sealed this

Twenty-second Day of March 1977

[SEAL]

*Attest:*

RUTH C. MASON
*Attesting Officer*

C. MARSHALL DANN
*Commissioner of Patents and Trademarks*